US007536953B2

(12) United States Patent
Bisutti

(10) Patent No.: US 7,536,953 B2
(45) Date of Patent: May 26, 2009

(54) SYSTEM FOR ROLL IMPREGNATION

(75) Inventor: Arrio Vavassori Bisutti, Bergamo (IT)

(73) Assignee: Policrom Screens S.p.A., Carvico (IT)

( * ) Notice: Subject to any disclaimer, the term of this patent is extended or adjusted under 35 U.S.C. 154(b) by 536 days.

(21) Appl. No.: 11/289,062

(22) Filed: Nov. 29, 2005

(65) Prior Publication Data

US 2006/0075913 A1 Apr. 13, 2006

Related U.S. Application Data

(63) Continuation-in-part of application No. PCT/IT03/00460, filed on Jul. 25, 2003.

(51) Int. Cl.
*B41F 35/00* (2006.01)

(52) U.S. Cl. ..... 101/424; 101/425

(58) Field of Classification Search ..... 101/424, 101/425

See application file for complete search history.

(56) References Cited

U.S. PATENT DOCUMENTS 4,031,889 A * 6/1977 Pike ..... 604/144
5,153,964 A * 10/1992 Gelardi et al. ..... 15/229.12
5,368,157 A 11/1994 Gasparrini
5,373,936 A * 12/1994 Kawai et al. ..... 206/204
5,605,731 A * 2/1997 Guasch Pubill ..... 428/43
5,974,976 A 11/1999 Gasparrini
6,038,731 A * 3/2000 Hara et al. ..... 15/256.51
6,263,795 B1 * 7/2001 Gasparrini et al. ..... 101/425
6,554,156 B1 * 4/2003 Chong ..... 221/63

FOREIGN PATENT DOCUMENTS

EP 0741034 A2 11/1996
EP 0747218 A3 1/1997

* cited by examiner

*Primary Examiner*—Anthony H. Nguyen
(74) *Attorney, Agent, or Firm*—William H. Eilberg

(57) ABSTRACT

A pre-packaged cleaning system or kit is used for transport, storage and solvent impregnation of one or more fabric rolls used for cleaning components of printing machines. A container holds one or more fabric rolls, and one or more bags containing a solvent. When the rolls are to be used, the bags are perforated, allowing the solvent to flow onto the rolls. Thus, the rolls can be impregnated with solvent immediately before use. Because they are stored separately, the rolls and solvent are not likely to deteriorate even during long periods of storage.

23 Claims, 3 Drawing Sheets

SYSTEM FOR ROLL IMPREGNATION

CROSS-REFERENCE TO PRIOR APPLICATION

This is a continuation-in-part of International Application No. PCT/IT2003/000460, having an international filing date of Jul. 25, 2003.

FIELD OF THE INVENTION

The present invention relates to the printing industry, and provides a pre-packaged cleaning system or kit for transportation and storage of fabric rolls intended for cleaning printing blankets and cylinders used to distribute printing inks within printing machines. The invention provides apparatus for storage of the fabric rolls separately from a solvent, so that the fabric rolls can later be impregnated with the solvent for use in the cleaning operation.

BACKGROUND OF THE INVENTION

Several systems exist for cleaning screens and cylinders used for distributing inks and varnishes necessary for printing. These cleaning operations are necessary each time it is required to pass from the printing of one subject to another on the same printing machine. Cleaning is also required when printing the same subject in very large numbers, since the cylinders or blankets accumulate excess ink that could produce undesired results in the final printing. Cleaning is also necessary when it is necessary to change the type or range of ink used in the printing machine.

The simplest cleaning method consists of soaking a piece of fabric, or imitation fabric such as a non-woven fabric (generally obtained through a mixture of polyester and cellulose pulp together with a small amount of binders of the two basic products), with an appropriate solvent product for printing inks, and using such soaked fabric to clean the printing machine by hand.

A more sophisticated method requires the use of a non-woven fabric manufactured in rolls having the same width as the printing machine. The non-woven fabric rolls are loaded on an automatic device, which is designed to unroll the aforesaid fabric, to spray the non-woven fabric with a printing ink solvent product, and to place the non-woven fabric soaked with solvent in contact with the ink-soiled machine cylinders, making them rotate. Due to the contact between the non-woven solvent-soaked fabric and the ink-coated cylinders, the ink is transferred from the cylinders onto the non-woven fabric. The non-woven fabric, now dirty with ink, is re-wound on an automatic winding shaft, while the clean non-woven fabric left on the roller is unwound, sprayed with solvent and placed in contact with the printing machine cylinders. Through this process, the non-woven fabric is passed from the roll through the cylinders until the roll is totally unwound, thus obtaining several total cleaning cycles of cylinders and printing blankets.

The cleaning system described above is the most widely used and requires an automatic device with various components including the following: a container filled with solvent; a distribution pump for the solvent; a set of nozzles for homogeneous distribution of the solvent on the non-woven fabric; a system to collect excess solvent; and all the equipment necessary for unwinding the clean non-woven fabric and then rewinding the used non-woven fabric roll soiled with printing ink.

A third automatic cleaning system requires the use of non-woven fabric rolls previously soaked with solvent and packed in sealed plastic bags for easy transport and storage. These rolls are placed in an automatic device composed of a clean non-woven fabric unwinding system and a rewinding system for the soiled non-woven fabric. The device used with this method is much more simple in that the use of pre-moistened non-woven fabric does not require a solvent tank, a distribution pump, spray nozzles, or a system to collect excess or waste solvent.

This third cleaning system is described in U.S. Pat. No. 5,368,157 and U.S. Pat. No. 5,974,976, both to Gasparrini et al. The disclosures of the above-cited patents are incorporated by reference herein.

The methods described in the above-cited patents have a variety of drawbacks arising from the prolonged storage of the solvent soaked rolls in a warehouse. Indeed, non-woven materials that are left in contact with solvents for long periods tend to wear out and lose part of their tensile strength. The longer the fabric remains impregnated with the solvent, the greater the loss of strength. The tensile strength is a very important feature because the non-woven fabric is stretched between the two rollers of the cleaning system so as to be rubbed vigorously against the rotating cylinder that is to be cleaned. Laboratory tests and dynamometrical controls run by the Applicant have demonstrated that the most common types of non-woven fabric lose part of their tensile strength when soaked in solvents, reducing their breaking load ($N/mm^2$) by about 20%. The breaking load continues to be reduced progressively the longer the non-woven fabric remains impregnated with the solvent. This condition consequently leads to fabric rotting.

On the other hand, the solvent product loses part of its chemical characteristics by reacting with the non-woven fabric, and, above all, with the bonding agents used for manufacturing the fabric. Moreover, the air that is inevitably contained within the non-woven fabric tends to oxidize the solvent with the subsequent reduction of its cleaning properties.

U.S. Pat. No. 5,974,976, cited above, aims to resolve some of the problems illustrated above through the introduction of a small variant, namely, the extraction of some of the air from the non-woven fabric. However, since the air is not completely extracted, the solvent oxidization is only partially reduced, and consequently, the damage caused may be permanent.

There exists therefore a need for providing new systems for cleaning printing blankets and cylinders used for the distribution of ink and varnish in printing operations, that do not exhibit the disadvantages of manual cleaning methods. Such disadvantages include low efficiency and high cost, complexity of the systems, the need for continuous maintenance, the risk of interruptions during printing operations, and finally the high cost of the automatic cleaning systems. Such automatic cleaning systems comprise several components, including fabric rolls, preferably non-woven fabric rolls, that are impregnated using spraying nozzles at the moment they are to be used on the printing rollers. Other disadvantages include the problems of rotting, breaking load loss, material deterioration, both with regard to the fabric roll and the impregnating solvent, due to contact between the roll and the solvent for long periods. Another disadvantage is the oxidization of the solvent by the air remaining in the non-woven roll material, since even if air is removed from a sealed container in which the roll is stored, such removal of air is, at best, only partial.

SUMMARY OF THE INVENTION

The invention comprises a system and method for storing and transporting one or more fabric rolls for use in cleaning offset printing cylinders or blankets, and for impregnating such rolls with solvents useful in removing inks or varnish from such cylinders or blankets. The invention comprises a pre-packaged cleaning system or kit.

The system or kit of the present invention includes a container 1, provided with a removable, hermetically sealed cover 2, the container holding at least one fabric roll 3, and at least one one sealed bag 4 which can be perforated or cut or torn, the bag containing a solvent or solvent mixture 5 for use in removing printing inks or varnishes. The system includes spikes 7 for perforating the bag, so as to enable the stored solvent to flow onto the rolls, thereby impregnating the rolls with solvent.

In another embodiment, a compartment holding the bag is separated from a compartment containing the rolls by a colander or plate having perforations. When the bag is perforated, cut, or torn, the solvent flows through the holes in the colander, and thereby becomes evenly distributed over the rolls. In this way, the rolls become substantially uniformly saturated with the solvent. The perforating means can be disposed inside the bag, or it can be located outside the bag, such as by attaching a blade to the colander.

The present invention permits the easy transport of the fabric rolls and solvent, in separate compartments. Moreover, the present invention provides enhanced safety during handling and transport, because even in the unlikely case of accidental rupture of the bag containing the solvent, the perfect sealing of the container and its cover, as well as the presence of the fabric rolls which can absorb the total amount of the solvent, substantially eliminates the possibility of dangerous leakage.

Because the fabric and solvent are packed in separate compartments, the product can be conveniently stored, with virtually unlimited shelf life. The fabric roll is impregnated with solvent only immediately prior to use. Thus, the invention avoids the problem of a fabric roll becoming useless from deterioration or rotting, due to prolonged contact with the solvent. The invention also prevents the solvent from oxidizing due to prolonged contact with the fabric roll material, which would subject it to chemical and/or physical alterations which render it unsuitable for removing ink and varnish from offset printing machine blankets and cylinders. The invention also permits the impregnation of fabric rolls with solvents immediately before use in an automatic system for the removal of inks and varnishes from printing blankets and cylinders of offset printing machines.

The present invention therefore has the primary object of providing a system and method for storing and transporting fabric rolls and solvent, the fabric rolls being intended for use in cleaning of components of printing machines.

The invention has the further object of providing a system and method in which fabric rolls are transported and stored without being impregnated with solvent, so that the rolls are not subject to deterioration due to prolonged exposure to the solvent.

The invention has the further object of providing a system and method in which fabric rolls can be impregnated with solvent immediately before the rolls are used in cleaning of components of printing machines.

The invention has the further object of providing a system and method for distributing solvent uniformly over fabric rolls, which can then be used in cleaning of components of printing machines.

The invention has the further object of providing an apparatus for storing and transporting fabric rolls and solvent, wherein the solvent is provided in an exact, or nearly exact, quantity necessary to impregnate the rolls contained in the apparatus.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1:
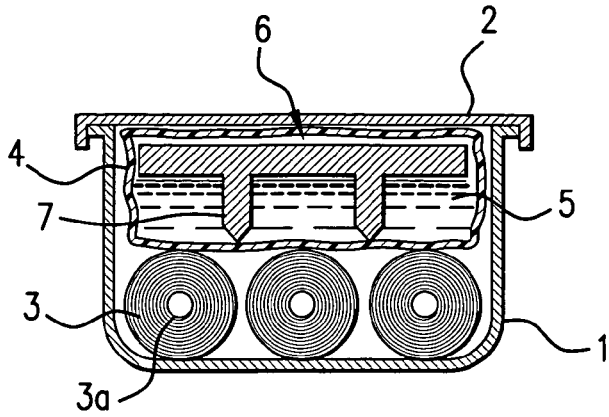
FIG. 1 provides a cross-sectional end view of one embodiment of the system of the present invention.
Figure 2:
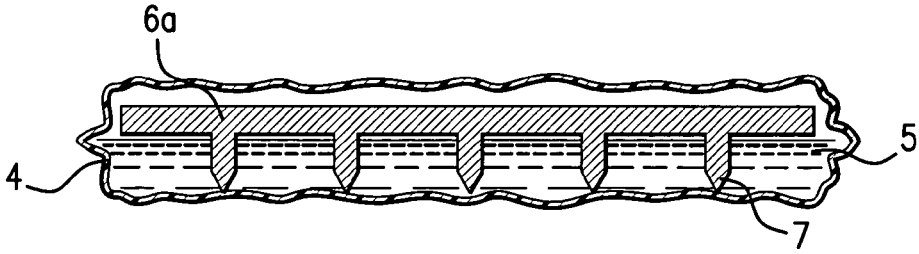
FIG. 2 provides a cross-sectional view of a bag which holds the solvent, in the system of the present invention, and the plate having spikes or blades, used to perforate the bag.
Figure 3:
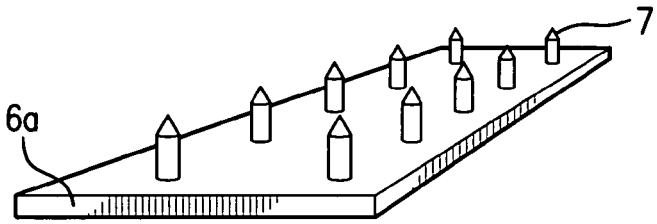
FIG. 3 provides a perspective view of the plate having spikes or blades, used to perforate the solvent-containing bag, in the system and method of the present invention.

The purpose of the present invention is to provide a pre-packaged cleaning system or kit for transport, storage, and impregnation with solvent(s) for printing inks or varnishes, of one or more fabric rolls to be used to clean printing screens and cylinders.

In one embodiment, as illustrated in FIGS. 1-4, the invention comprises container 1 having removable, hermetically sealed cover 2. The container holds at least one fabric roll 3, and at least one sealed bag 4 that can be perforated, cut or torn. The bag 4 contains the solvent 5, or solvent mixture, the solvent being intended for use in removing printing ink or varnish from components of printing machines.

In one preferred embodiment of the present invention, the sealed bag 4 is provided with at least one tear-open device.

In a further preferred embodiment, the system or kit of the present invention also includes at least one means 6 for perforating or cutting the bag, such means including one or more protruding spikes 7.

The protruding spikes 7 could be chosen to have the shape of a spike, a blade or a barb, or any other device capable of cutting, tearing, or perforating the bag.

Figure 4:
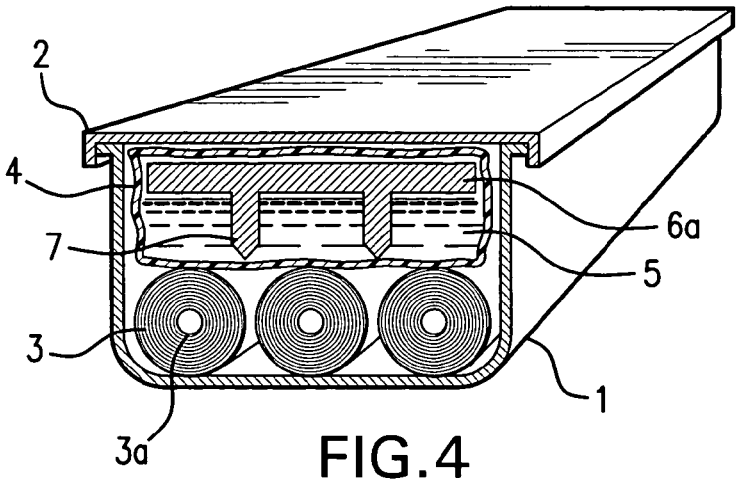
FIG. 4 provides a perspective view, partly in cross-section, showing the kit of the present invention, including the bag containing the solvent and the rolls to be impregnated.

Preferably, the protruding spikes should be positioned so that they cannot perforate the fabric roll or rolls, especially when the sealed bag 4 containing a means of perforation including such spikes, is laid on top of the fabric roll or rolls. That is, as shown in FIGS. 1 and 4, for example, the spikes 7 are staggered, relative to the rolls, so that in the event of accidental perforation of the bag, the spikes will not cut or damage the rolls.

Preferably, the cutting or perforation means 6 is placed inside the container 1 and, more preferably, is placed inside the sealed bag 4.

In a further and particularly preferred embodiment of the pre-packaged cleaning system or kit according to the present invention, the perforation or cutting means comprises a plate 6*a*, with at least one of its two surfaces having one or more protruding spikes 7, which can still have the shape of spikes, blades, or barbs, or other cutting device.

The sealed cover 2 can be re-applied or re-positioned on the container, especially after the bag 4 has been perforated, to prevent the dispersion of solvent into the environment outside the container after the rolls have been impregnated with solvent.

The sealed bag 4 containing the solvent is filled completely, to eliminate any presence of residual air inside the bag, thus preventing any oxidizing of the solvent. The bag can be made of a material chosen from the group comprising: metallized plastic film, plastic film bonded to a metal film (preferably but not necessarily aluminum), paper or cardboard bonded with plastic film or metallized plastic, paper or cardboard waterproofed with wax or synthetic paper, or cardboard or plastic waterproofing products. The above list is not intended to limit the invention to the use of the listed materials.

Figure 5:
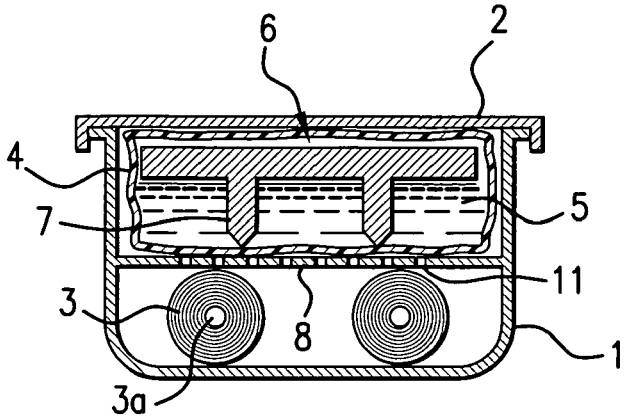
FIG. 5 provides a cross-sectional end view, similar to that of FIG. 1, showing an alternative embodiment of the invention, wherein there is a colander separating the bag from the rolls.
Figure 6:
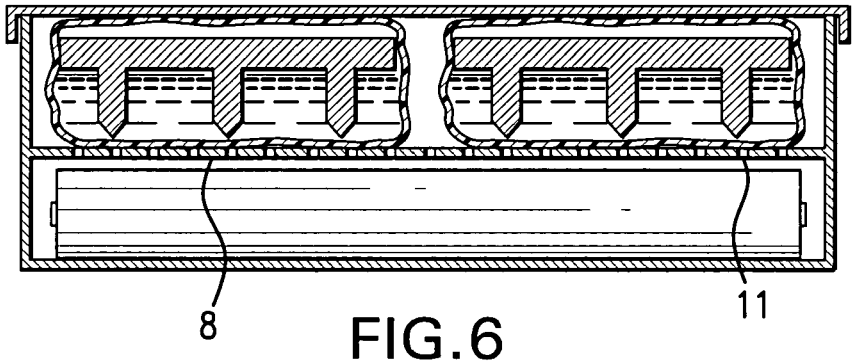
FIG. 6 provides a cross-sectional view, similar to FIG. 2, showing the alternative embodiment of FIG. 5, and in which there is more than one bag containing solvent.
Figure 7:
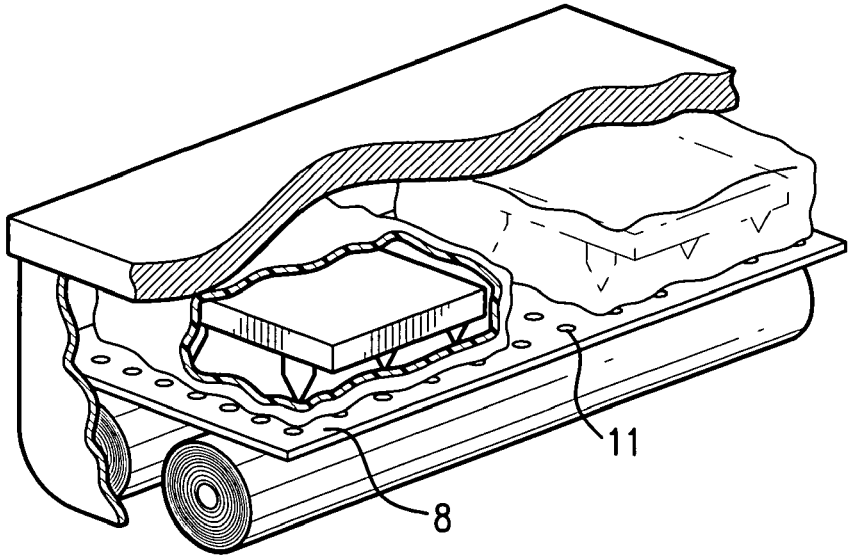
FIG. 7 provides a perspective view, partly broken away, of the alternative embodiment of FIGS. 5 and 6.

Another embodiment of the invention is shown in FIGS. 5-7. In this embodiment, a perforated dispenser plate or colander 8 is positioned between the sealed bags 4 and the fabric rolls 3. FIGS. 5-7 show perforations 11 in the colander. The colander effectively divides the interior of the container into two compartments, one for the bag or bags, and one for the roll or rolls. The colander serves to distribute the solvent evenly over the rolls of fabric, due to the plurality of perforations in the colander, the perforations being uniformly distributed over the area of the colander. Thus, when the bag or bags are perforated, cut, or torn, and the solvent flows out, the solvent flows by gravity through many or most of the holes of the colander, thereby insuring a substantially uniform distribution of solvent across a relatively wide area. The fabric rolls therefore become substantially uniformly impregnated with the solvent.

As noted above, there may be one or more bags in the container. Each bag may have a separate perforation means. FIGS. 6 and 7 explicitly illustrate the case in which there are at least two bags, each bag having its own perforation device. The embodiment of FIGS. 1-4 could similarly be provided with a plurality of bags, and a plurality of perforation devices.

Preferably, the bag 4 comprises a plastic material chosen from a group which includes polyolefins, polyethylene, polypropylene, polyvinyl chlorides, and polyamides. The afore-mentioned list is not intended to limit the invention to the use of the listed materials.

More preferably, the bag 4 comprises a material chosen from the group comprising polyamides or nylon, preferably polyamide 6, polyamide 6,6 or polyamide 6,10.

Preferably, the bag 4 contains a quantity of solvent that is at least the exact amount necessary for the impregnation of the surface of the roll or rolls contained in the bag. This amount is easily calculated, since it depends on the chemical properties and quantity of the absorbent component of which the roll fabric is made, and on the chemical properties of the solvent that is used. Thus, the solvent can be provided in a quantity which corresponds with the absorbent capacity of the fabric roll, relative to the solvent present in the container.

The most common method used to determine the quantity of solvent needed comprises weighing a sample of the fabric having a known surface area, for example 10 $cm^2$, followed by weighing the same sample after the sample has been totally immersed in the solvent and left to drip for one minute. The difference between the two weights constitutes the absorbent capacity in grams/$cm^2$ in relation to the type of material of which the fabric is made and the kind of solvent employed.

The container 1 and the removable sealed cover 2 can be made of materials chosen from the group comprising: plastic material, metal, metallized plastic, synthetic paper or cardboard, metallized paper or cardboard, or paper or cardboard laminated or bonded with metal or plastic sheets, or paper or cardboard waterproofed with wax or plastic waterproofing products.

Preferably, the container 1 and the cover 2 are made of materials comprising plastic materials chosen from the following group: plastic materials with a thermosetting resin base chosen from the group composed of polyester resin, epoxy resin, phenolic resin, melamine resin; plastic materials with a thermoplastic resin base chosen from the group comprising: acrylonitrile butadiene styrene resin (ABS), polystyrene resin, polyvinyl chloride resins (PVC), fluoroplastics, polysulfones, polypropylene resins, styrene-acrylonitrile resins, nylon, phenylen oxides.

In another preferred embodiment of the present invention, the container 1 and the cover 2 are made of a material comprising a plastic material chosen from the group comprising polyethylene, polypropylene, polyvinyl chlorides and polyamides, and polyester.

The perforating or tearing means 6 comprising one or more protruding spikes 7 can be made of a material chosen from plastic materials, metal, wood, or a combination of the above materials.

Preferably, the plastic material is chosen from plastic materials with a thermosetting base, chosen from the group composed of: acrylonitrile butadiene styrene resin (ABS), polystyrene resin, polyvinyl chloride resins (PVC), fluoroplastics, polysulfones, polypropylene resins, styrene-acrylonitrile resins, nylon, phenylen oxides.

Due to the fact that the bag 4 can be perforated, cut or torn, the system or kit of the present invention permits the release of the solvent and its dispersion on the roll or rolls so that they are moistened by the solvent. Such release of solvent is facilitated by the perforation or cutting means, and especially when such perforation or cutting means is inserted within the bag 4 which holds the solvent. The bag or bags can be perforated by manually exerting moderate pressure on the plate provided with spikes, blades, or barbs, so as to perforate or cut the bag(s) in one or more locations. One can manipulate the sealed bag, from the outside of the bag, i.e. while the bag is still sealed, in a manner sufficient to cause the spikes, or other perforating means, to penetrate at least a portion of the bag.

Perforation of the bag(s) impregnates the roll or rolls immediately so that they can be used within a period ranging from a few seconds up to a maximum period of three weeks. After such period of about three weeks, the problems of rotting of the fabric and/or oxidation of the solvent may occur.

The above-described method makes the roll or rolls suitable for use in an automatic device, characterized by the simple mounting of two motor controlled rollers, the first for unwinding the clean impregnated fabric (or non-woven fabric), and the second for rewinding the fabric (or non-woven fabric), soiled by the removal of the inks and varnishes from the offset printing machine cylinders.

In a further embodiment of the present invention, the bag or bags 4 and the fabric roll or rolls 3 inside the container 1 are positioned adjacent to each other. Alternatively, the bag can be placed over or under the fabric roll. Also, the bag or bags could be interposed horizontally or vertically with the fabric roll or rolls. Preferably the bag is positioned adjacent to the fabric roll or rolls, or placed on top of the rolls. More preferably, the bag or bags are placed on top of the fabric roll or rolls.

Figure 8:
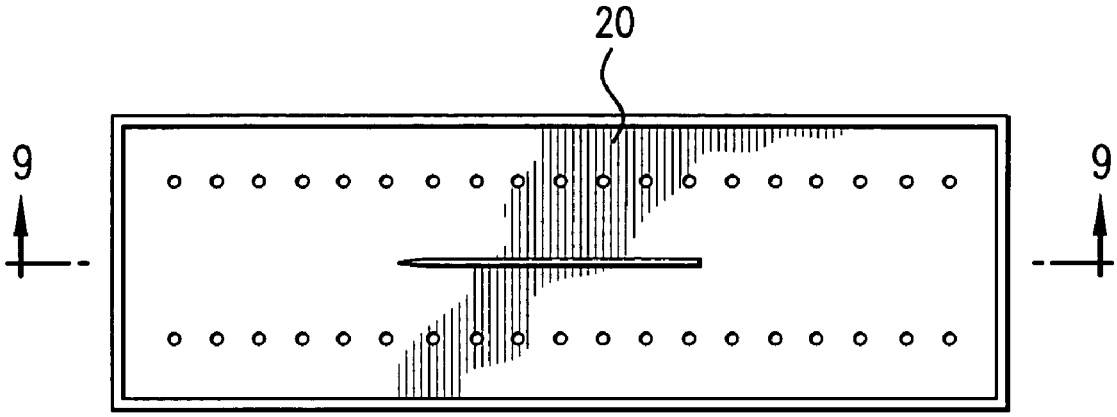
FIG. 8 provides a top view of a colander made according to another embodiment of the invention, wherein a perforating means is attached to the colander.
Figure 9:
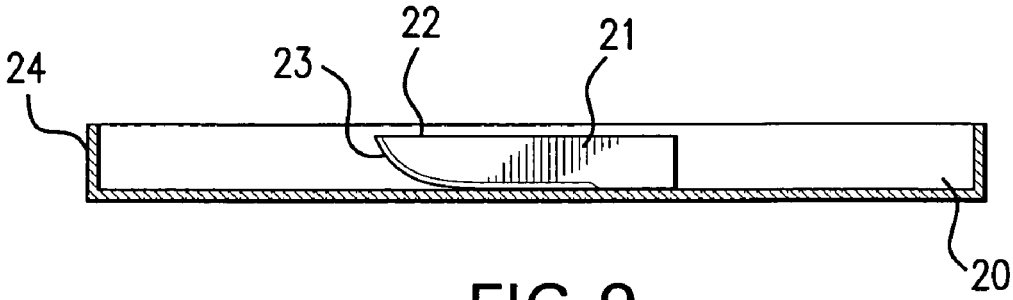
FIG. 9 provides a cross-sectional view taken along the line 9-9 of FIG. 8, showing the perforating means attached to the colander.

FIGS. 8 and 9 illustrate another embodiment of the invention. In this embodiment, the perforating means is located inside the container, but outside the bag. In particular, the perforating means comprises blade 21 which is embedded in colander 20. To prevent accidental puncture of the bag(s), and to prevent injury to personnel, the dull part 22 of the blade faces upward, i.e. towards the user, and the sharp portion 23 of the blade faces downward, i.e. towards the colander. The user can then move the bag or bags over the blade, so that the blade engages the bag and punctures it. In the embodiment shown, the colander includes a side wall or flange 24, which serves to contain the liquid after the bag has been punctured, and before the liquid has passed through the perforations. The position and configuration of the blade can be varied, within the scope of the present invention.

The cleaning method and the pre-packaged cleaning system or kit of the present invention, comprise, as a basic element, one or more fabric rolls 3 comprising a core, such as elongated cylinder 3*a*. The cylinder may be, for example, a cardboard cylinder sufficiently strong and resistant to support a fabric roll of paper or cloth. The core can also be made of plastic and/or metal such as steel, aluminum or the like. The core is designed to be mounted on the cleaning device, on one unwinding roller and on the other rewinding roller of the fabric rolls, present in automatic washing devices on printing machines, in a manner so that the fabric is rubbed vigorously against the cylinders to be cleaned.

The fabric on the fabric rolls according to the present invention is understood as being both a woven material and non-woven material. Therefore, the fabric can comprise a woven fabric or a non-woven fabric, or mixtures thereof. Preferably, the fabric roll is made of a non-woven fabric.

The material used to make the fabric roll can comprise paper or cloth. In the case where the fabric in question is a cloth, this can be a woven or non-woven cloth made of natural or synthetic fibers or mixtures thereof. Without limitation, examples of materials that can be used for the synthetic fibers are polyester fibers, rayon fibers, nylon fibers, acrylic fibers and the like. Without limitation, examples of materials that can be used for the natural fibers are cotton fibers, wood-pulp fibers, hemp fibers and the like.

In cases where the rolls are made of paper fabric, the rolls could be made of chemically modified wood pulp, made according to available paper manufacturing technology.

Preferably, the material used to make the roll fabric comprises a non-woven cloth obtained from a mixture of polyester floss and cellulose pulp in blend percentages that can vary between 40% of one material and 60% of the other and vice versa.

In a further embodiment of the present invention, the roll fabric is made of a non-woven fabric where, together with the polyester floss and cellulose pulp, the mixture also includes one or more binders or bonding resins normally used in non-woven fabrics, up to a maximum of 10% of the mixture of the non-woven fabric, where the sum of the percentages of polyester floss, cellulose pulp and bonding resins always totals 100.

The solvent 5, or mixtures of solvents, contained in the bag 4, are preferably one or more solvents for inks or varnishes, more preferably solvents for printing inks or varnishes, and even more preferably solvent for relief printing or lithographic inks or varnishes.

In particular, the term solvent or solvent mixture according to the present invention refers to organic solvents, including aliphatic and aromatic compounds or mixtures thereof, or suspensions or emulsions, or dispersion in water of said organic solvents.

Preferably the organic solvents or solvent mixtures according to the present invention are solvents with an oil extract base, or solvents with a mineral oil base or hydrocarbon solvents.

Preferably the solvent or solvent mixture according to the present invention are one or more solvents chosen from solvents with low, medium or high volatility.

In a particularly preferred embodiment, the cleaning method and the related cleaning system or kit, as shown in FIG. 1, comprises a container 1 provided with a removable, hermetically sealed cover 2, the container holding at least one fabric roll 3, the fabric comprising a non-woven material that has not been subjected to any previous treatment to reduce the air content of the fabric, and over each roll or group of rolls is positioned at least one bag 4 filled with a quantity of solvent 5 in proportion to the absorbing capacity of the total surface of the roll or group of rolls of non-woven fabric underneath. The bag is sealed after being completely filled in a manner so as not to allow any air bubbles inside that might oxidize the solvent contained in the bag. The bag 4 contains at least one small plate 6*a*, having on at least one of its two surfaces, one or more protruding spikes 7, or blades or barbs. The plate, when subjected to moderate pressure, is able to perforate the bag containing the solvent so as to release the solvent, thus impregnating the roll or rolls of non-woven fabric present in the same container.

The present invention also includes a new cleaning method for printing cylinders and blankets. That is, after the fabric roll or rolls have been impregnated with solvent as described above, the method comprises the positioning of an unwinding roller and a rewinding roller for the fabric rolls in the cleaning devices present in the automatic washing systems on printing machines.

In a further embodiment of the system or kit according to the invention, the bag 4, containing a quantity of solvent or solvent mixture necessary for the exact impregnation of the surface of the fabric roll or rolls contained in the bag, is replaced by a coating layer applied on the fabric making up the rolls.

The coating layer contains micro-bags or microcapsules or micro-bladders containing a quantity of solvent or solvent mixture necessary for the exact impregnation of the surface of the fabric roll or rolls contained in the container.

The micro-bags or microcapsules or micro-bladders, when subjected to moderate pressure, are able to break so as to release the solvent or solvent mixture therein contained and disperse it into the non-woven fabric roll or rolls onto which said coating layer of micro-bags or microcapsules or micro-bladders is applied.

Preferably the micro-bags, microcapsules or micro-bladders are composed of resins or jellies able to contain within little drops of solvent or solvent mixture for the cleaning of printing inks or varnishes.

The method and the related pre-packaged cleaning system or kit according to the present invention presents the following advantages compared to current existing cleaning systems:

I. There are no limits to product shelf-life because the physical separation of the two components (i.e. the material comprising the fabric roll and the solvent product) prevents any interaction between the two, with the consequent advantages for product storage;

II. Perfect conditions of the components of the system are guaranteed, both as far as the chemical features of the solvent are concerned, and as far as the physical-mechanical features (i.e. the breaking load) of the material making up the roll fabric are concerned, because the perforation of the solvent bag and the consequent impregnation of the fabric occur at the very moment the cleaning system is to be used;

III. Perfect measurement of the solvent dose is guaranteed, i.e. the quantity that corresponds exactly to the absorption capacity of the fabric surface of the roll or rolls to be impregnated;

IV. All costly operations necessary to extract air from the fabric material are no longer necessary, since the fabric can be used in its original condition;

V. Maximum safety can be guaranteed during transport and handling of the packed products, because in the unlikely event that one of the bags might accidentally break, the solvent will be totally absorbed by the rolls underneath without the slightest risk of leakage; and VI. The method permits the use of any kind of solvent whatsoever for printing inks or varnishes, including organic or inorganic solvents, having low, medium or high volatility.

The invention can be modified in ways which will be apparent to the reader skilled in the art. Such modifications should be considered within the spirit and scope of the following claims.

What is claimed is:

1. Apparatus for transport, storage, and impregnation with solvent, of fabric rolls for use in cleaning printing blankets and cylinders, comprising:

a) a container, b) the container holding at least one fabric roll, c) the container also holding at least one bag made of a material capable of being perforated, cut, or torn, the bag containing a solvent for printing inks or varnishes, wherein the fabric roll is stored in the container without being in contact with the solvent.

2. The apparatus of claim 1, further comprising means for perforating the bag.

3. The apparatus of claim 2, wherein the perforating means is disposed within the bag.

4. The apparatus of claim 2, wherein the perforating means is located inside the container, and outside the bag.

5. The apparatus of claim 3, wherein the perforating means comprises a spike.

6. The apparatus of claim 1, wherein the container includes an attachable, removable, and reattachable cover, wherein the cover comprises a hermetic seal for the container.

7. The apparatus of claim 1, further comprising a colander, disposed within the container, the colander being located between the bag and the roll, the colander having a plurality of holes for distributing solvent substantially uniformly over the roll.

8. The apparatus of claim 7, further comprising a blade attached to the colander.

9. The apparatus of claim 2, wherein the perforating means comprises a plate having a plurality of perforating devices, wherein the perforating devices are positioned above the roll, the perforating devices being staggered relative to the roll, wherein the perforating devices are oriented so as not to cut the roll in the event of accidental perforation of the bag.

10. The apparatus of claim 1, wherein the bag is made of a material selected from the group consisting of metallized plastic film, plastic film bonded to a metal film, paper or cardboard bonded with plastic film or metallized plastic, paper or cardboard waterproofed with wax or plastic, and synthetic paper or cardboard waterproofing products.

11. The apparatus of claim 1, wherein the bag is made of a plastic material selected from the group consisting of polyolefins, polyethylene, polypropylene, polyvinyl chloride, and polyamides.

12. The apparatus of claim 1, wherein the bag contains a quantity of solvent which is at least a quantity of solvent necessary for complete impregnation of the roll.

13. Apparatus for storage, transport, and solvent impregnation of a plurality of fabric rolls, the rolls being used for cleaning components of printing machines, the apparatus comprising:

a) a container having a removable and reattachable cover, the cover defining a hermetic seal for the container, b) a plurality of fabric rolls disposed within the container, c) a bag disposed within the container, the bag being made of a material capable of being perforated or torn, the bag containing a solvent for printing inks or varnishes, and d) means for perforating the bag, the perforating means being located within the container.

14. The apparatus of claim 13, wherein the perforating means is disposed within the bag.

15. The apparatus of claim 13, wherein the perforating means is disposed outside the bag.

16. The apparatus of claim 13, wherein the perforating means includes a plate having a plurality of spikes protruding from the plate.

17. The apparatus of claim 13, wherein the spikes are staggered relative to the rolls so as not to cut the rolls in the event of accidental rupture of the bag.

18. The apparatus of claim 13, wherein the container includes a colander which divides the container into compartments, wherein the bag is located within a first compartment, and wherein the rolls are located within a second compartment, the colander having holes which cause solvent from the bag to be substantially uniformly distributed over the rolls.

19. The apparatus of claim 18, wherein the perforating means comprises a blade attached to the colander.

20. The apparatus of claim 13, wherein the bag contains a quantity of solvent which is based on a quantity of solvent needed for complete impregnation of the rolls.

21. Apparatus for transport, storage, and impregnation with solvent, of fabric rolls for use in cleaning printing blankets and cylinders, comprising:

a) a container, b) the container holding at least one fabric roll, c) the container also holding at least one bag made of a material capable of being perforated, cut, or torn, the bag containing a solvent for printing inks or varnishes, further comprising means for perforating the bag, wherein the perforating means is located inside the container, and outside the bag.

22. Apparatus for transport, storage, and impregnation with solvent, of fabric rolls for use in cleaning printing blankets and cylinders, comprising:

a) a container, b) the container holding at least one fabric roll, c) the container also holding at least one bag made of a material capable of being perforated, cut, or torn, the bag containing a solvent for printing inks or varnishes, further comprising a colander, disposed within the container, the colander being located between the bag and the roll, the colander having a plurality of holes for distributing solvent substantially uniformly over the roll.

23. The apparatus of claim 22, further comprising a blade attached to the colander.

* * * * *